US009384908B2

(12) United States Patent
Spies

(10) Patent No.: US 9,384,908 B2
(45) Date of Patent: Jul. 5, 2016

(54) CIRCUIT-BREAKER COMPRISING OPTIMIZED HOUSING STABILISATION BY MEANS OF FIXED CONTACTS WITH AN INTERLOCKING ACTION

(75) Inventor: Alexander Spies, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 56 days.

(21) Appl. No.: 14/127,208

(22) PCT Filed: Sep. 3, 2012

(86) PCT No.: PCT/EP2012/067123

§ 371 (c)(1),
(2), (4) Date: Jul. 22, 2014

(87) PCT Pub. No.: WO2013/041357

PCT Pub. Date: Mar. 28, 2013

(65) Prior Publication Data

US 2015/0008106 A1 Jan. 8, 2015

(30) Foreign Application Priority Data

Sep. 21, 2011 (EP) ..... 11182091

(51) Int. Cl.

| | |
|---|---|
| ***H01H 1/36*** | (2006.01) |
| ***H01H 1/06*** | (2006.01) |
| ***H01H 1/20*** | (2006.01) |
| ***H01H 71/02*** | (2006.01) |
| *H01H 73/04* | (2006.01) |

(52) U.S. Cl.

CPC ..... *H01H 1/06* (2013.01); *H01H 1/2008* (2013.01); *H01H 71/0214* (2013.01); *H01H 71/0257* (2013.01); *H01H 73/045* (2013.01)

(58) Field of Classification Search

CPC ..... H01H 1/00; H01H 1/36; H01H 3/00; H01H 3/02; H01H 3/04; H01H 3/12; H01H 3/32; H01H 5/00; H01H 5/18; H01H 5/22; H01H 33/00; H01H 69/00; H01H 71/00; H01H 71/10; H01H 71/52; H01H 2203/00; H01H 2205/00; H01H 71/08; H01H 73/00; H01H 73/02; H01H 73/04; H01H 73/045; H01H 73/20; H01H 73/24; H01H 73/38; H01H 1/20; H01H 75/00; H01H 77/00; H01H 33/025; H01H 2001/58; H01H 2003/02; H01H 2071/08; H01H 2071/10

USPC ..... 200/252, 19.22, 19.27, 6 R, 10, 11 TC, 200/6 A, 50.21, 410, 435, 553

See application file for complete search history.

(56) References Cited

U.S. PATENT DOCUMENTS 2,840,657 A * 6/1958 Roeser ..... 200/448
3,624,332 A * 11/1971 Van Benschoten et al. .. 200/409

(Continued)

FOREIGN PATENT DOCUMENTS

CN 1080429 A 1/1994
CN 201311857 Y 9/2009

(Continued)

OTHER PUBLICATIONS

International Search Report PCT/ISA/210 for PCT/EP2012/067123 dated Dec. 11, 2012.

(Continued)

*Primary Examiner* — Renee Luebke
*Assistant Examiner* — Anthony R. Jimenez
(74) *Attorney, Agent, or Firm* — Harness, Dickey & Pierce, P.L.C.

(57) ABSTRACT

A circuit breaker includes a sliding contact, in which a movable contact that is mounted on a spring is located, the contact lying opposite a fixed contact. In an embodiment, the fixed contact has a horn-shaped contour that engages in mating contours of the switching chamber walls of the circuit breaker.

6 Claims, 3 Drawing Sheets

(56) References Cited

U.S. PATENT DOCUMENTS

| | | | | |
|---|---|---|---|---|
| 4,618,748 | A | 10/1986 | Mueller | |
| 5,163,175 | A * | 11/1992 | Mori et al. | 335/132 |
| 5,635,886 | A * | 6/1997 | Pichard | 335/132 |
| 6,001,417 | A | 12/1999 | Nunotani et al. | |
| 6,831,239 | B2 * | 12/2004 | Van Den Akker et al. | 200/16 A |
| 2002/0149452 | A1 | 10/2002 | Baujan | |

FOREIGN PATENT DOCUMENTS

| | | | |
|---|---|---|---|
| DE | 19724710 | A1 | 2/1998 |
| DE | 19943965 | A1 | 3/2001 |
| EP | 0556109 | A1 | 8/1993 |
| EP | 1073084 | A2 | 1/2001 |
| JP | H0192726 | U | 6/1989 |
| JP | H1092726 | A | 4/1998 |
| WO | WO-0133595 | A1 | 5/2001 |

OTHER PUBLICATIONS

Written Opinion PCT/ISA/237 for PCT/EP2012/067123 dated Dec. 11, 2012.

Office Action for Chinese Patent Application No. 2012800356941 issued on Jul. 14, 2015 with English language translation.

* cited by examiner

CIRCUIT-BREAKER COMPRISING OPTIMIZED HOUSING STABILISATION BY MEANS OF FIXED CONTACTS WITH AN INTERLOCKING ACTION

PRIORITY STATEMENT

This application is the national phase under 35 U.S.C. §371 of PCT International Application No. PCT/EP2012/067123 which has an International filing date of Sep. 3, 2012, which designated the United States of America and which claims priority to European patent application number EP 11182091.6 filed Sep. 21, 2011, the entire contents of each of which are hereby incorporated herein by reference.

FIELD

At least one embodiment of the invention generally relates to a power circuit breaker comprising a contact slide, in which a movable switching piece is arranged mounted on a spring, which switching piece is arranged opposite a fixed switching piece.

BACKGROUND

Power circuit breakers, in particular low-voltage power circuit breakers, are automatic electromagnetic circuit breakers in the event of a short circuit. The way in which they function corresponds in principle to the way in which line circuit breakers function. They are usually equipped with a thermal and a magnetic release and therefore have the same structural elements as line circuit breakers. However, they are designed for higher rated currents, and in addition the releases are adjustable, sometimes separately, by power circuit breakers, which is different than in the case of line circuit breakers. In the low-voltage sector, the breakers are also used as motor circuit breakers.

The object of the power circuit breaker is to protect downstream installations, in particular three-phase motors, from damage as a result of overload or short circuit. The power circuit breaker should disconnect these currents in conjunction with the line protection devices. If gas is located between the two poles, this gas is ionized by virtue of the flashover in the case of a correspondingly high voltage difference between the poles, and a self-maintaining gas discharge, which is also referred to as an arc, is formed. This plasma not only continues to conduct current, but also reduces the life of the component part and, in the case of high currents, can even destroy the switch. In contrast to disconnectors, power circuit breakers are designed such that the arc produced during opening of the switching contacts is quenched and therefore the current flow is interrupted quickly and without any damage to the switch.

A particular problem associated with power circuit breakers with a high switching capacity, in particular up to 100 kA at rated currents of up to 80 A, consists in that, in the case of such large short circuits, the loading on the chamber walls, i.e. in particular on the lower part of the power circuit breaker owing to the high development of pressure, is very high. The housing walls can in the case of such tripping operations bend outwards or result in a rupture in the upper part of the power circuit breaker. In the worst case scenario, parts of the upper part are broken away.

In this regard, WO 01/33595 A1 describes an electrical circuit breaker, in particular a motor circuit breaker, comprising a housing including a thermosetting plastic, a switching contact arrangement, a tripping unit with at least one bimetallic-element release, a tripping link which acts on a switching mechanism and can be actuated by the bimetallic element and a parts mount consisting of insulating material for various contact and connection parts of the tripping unit which can be formed on this parts mount.

In the case of this electrical circuit breaker, provision is made for the preassemblable contact and connection parts of the tripping unit to be adhesively bonded into the housing or a housing part, with the result that the fastening of these preassemblable contact and connection parts in the housing takes place without any additional connections. For this, housing adhesive-bonding pockets are provided which are filled with adhesive material. Pins of the tripping unit protrude into these adhesive-bonding pockets and can be adhesively bonded in the adhesive-bonding pockets. By virtue of the permanent adhesive bonding, the bimetallic element position is kept stable. Thermal and mechanical stresses are considerably reduced by the use of the adhesive and by the adhesion process, while the thermal stability and dimensional stability are ensured.

SUMMARY

The inventor has discovered that a disadvantage with the prior art resides in that adhesive bonds are always subject to an ageing process and, in addition, the assembly process is complex since two parts always need to be guided with a precise fit with respect to one another for an adhesive bond.

Accordingly, at least one embodiment of the present invention is directed to a power circuit breaker which has stable housing walls even in the case of high switching powers and in the process provides for simple handling during assembly.

A power circuit breaker is disclosed. Advantageous designs and developments which can be used individually or in combination with one another are the subject matter of the dependent claims.

According to an embodiment of the invention, a power circuit breaker includes a contact slide, in which a movable switching piece is arranged mounted on a spring, which switching piece is arranged opposite a fixed switching piece. In an embodiment of the invention, the fixed switching piece has a horned contour, which engages in mating contours on the switching chamber walls of the power circuit breaker.

BRIEF DESCRIPTION OF THE DRAWINGS

Further advantages and embodiments of the invention will be explained below with reference to example embodiments and with reference to the drawing, in which, schematically.

DETAILED DESCRIPTION OF THE EXAMPLE EMBODIMENTS

Figure 1:
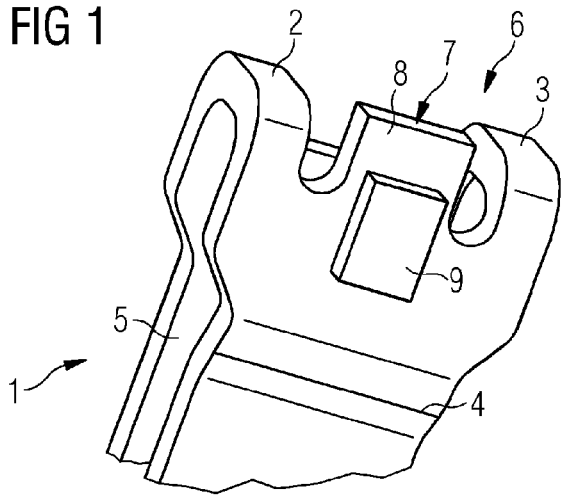
FIG. 1 shows a perspective illustration of part of a fixed switching piece according to an embodiment of the invention with horned contours and tabs.

According to an embodiment of the invention, a power circuit breaker includes a contact slide, in which a movable switching piece is arranged mounted on a spring, which switching piece is arranged opposite a fixed switching piece. In an embodiment of the invention, the fixed switching piece has a horned contour, which engages in mating contours on the switching chamber walls of the power circuit breaker.

The horned contours on the fixed switching piece clamp the switching chambers of the power circuit breaker precisely in the region of the greatest pressure development. The solution according to an embodiment of the invention provides for the fixed switching pieces to be shaped in such a way that they form a clamp in the central region of the switching chamber which holds together the respective side walls of the individual phases. A series circuit comprising in each case three clamps is thus formed. Overall, intermediate walls and outer walls are supported against one another. In order to enable the clamping, there is a relatively large cutout provided in the front region of the fixed switching pieces. The fixed switching pieces are also shaped by way of a tab such that as effective sealing of the switching chambers as possible is still ensured.

In the event of a short circuit, the degree to which the wall of the lower part bends outwards in the central region is thus limited. This limitation is approximately 20 to 25% of the previous extent of bending, by first approximation. The lower part is thus bent out by this amount to a lesser degree than was previously the case. Thus, the risk of the upper part being ripped out by the lower part being pressed against it is also reduced.

The fixed switching piece according to an embodiment of the invention with horned contours is preferably U-shaped and has two limbs aligned parallel to one another and a transition region which connects the two limbs to one another. In the transition region, the horned contours are preferably in the form of two webs which are aligned parallel to one another and are separated from one another by a cutout. Preferably a tab is formed within the cutout, which tab, as an extension of a limb of the fixed switching piece, reaches into the cutout and enlarges the resting area for soldering the contacts below the limb of the fixed switching piece. In addition, the tab acts as a seal between the upper part and lower part of the power circuit breaker.

The fixed switching pieces according to an embodiment of the invention with the horned contours are arranged on opposite sides of the contact slide and are positioned parallel to the movable switching piece in the contact slide, with the result that the respective contacts on the movable switching piece and on the fixed switching piece can impinge on one another in the event of a short circuit. The contact slide is integrated in a contact slide accommodating device within the housing of the power circuit breaker, which contact slide accommodating device is formed in such a way that housing walls or mating contours for the horned contours are provided between the horned contours and the tab of the fixed switching piece, which housing walls or mating contours form the accommodating areas for the horned contours. Preferably, three chambers aligned parallel to one another, which each accommodate a contact slide with two mutually opposite fixed switching pieces, are arranged within a power circuit breaker. Thus, a series circuit comprising in each case three chambers is formed.

The fixed switching pieces according to an embodiment of the invention with horned contours achieve considerable reinforcement of the switching chambers of the power circuit breaker without any additional parts. The bending of the housing is reduced by said fixed switching pieces. The switching pieces are fixed well, wherein the assembly sequence does not need to be changed. The protruding tab on the fixed switching piece firstly enables an enlargement of the resting area for the contacts, and secondly enables good sealing with respect to the upper part of the power circuit breaker. The open cross section towards the top is reduced from approximately 160 $mm^2$ to 60 $mm^2$. In the event of a short circuit, the bending of the wall of the lower part of the power circuit breaker in the central region is limited. This limitation is, by first approximation, 20 to 25% of the previous bending. The lower part is thus bent out by this amount less than was previously the case. Thus, the risk of the upper part of the power circuit breaker being ripped out by the lower part being pressed against it is also reduced.

FIG. 1 illustrates a fixed switching piece 1 according to the invention with horned contours 2, 3, which fixed switching piece is preferably U-shaped with two limbs 4, 5 aligned parallel to one another and a transition region 6, which connects the two limbs 4, 5 to one another. In the transition region 6, the horned contours 2, 3 are preferably in the form of two webs which are aligned parallel to one another and which are separated from one another by a cutout 7. Preferably, a tab 8 is formed within the cutout 7, which tab, as an extension of the limb 4 of the fixed switching piece 1, reaches into the cutout 7 and enlarges the resting area for soldering the contacts 9 beneath the limb of each fixed switching piece 1. In addition, the tab 8 acts as a seal between the upper part and the lower part of the power circuit breaker.

Figure 2:
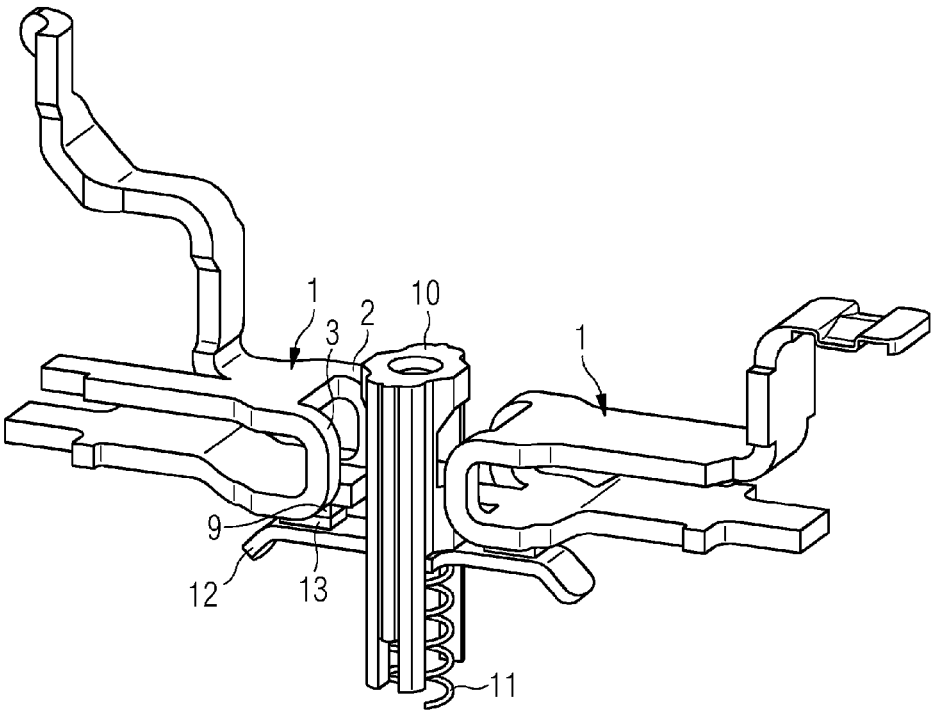
FIG. 2 shows a perspective illustration of an arrangement comprising two fixed switching pieces with horned contours and tabs and a contact slide with a movable switching piece.

FIG. 2 shows an arrangement comprising a contact slide 10 and two fixed switching pieces 1 which are arranged on the contact slide 10 and are opposite one another. A spring 11 on which a movable switching piece 12 with contacts 13 is mounted is arranged in the contact slide 10. The contacts 9 of the fixed switching pieces 1 are arranged opposite the contacts 13 of the movable switching piece 12. The fixed switching pieces 1 according to the invention with the horned contours 2, 3 are arranged on opposite sides of the contact slides 10 and are positioned parallel to the movable switching piece 12 in the contact slide 10, with the result that the respective contacts 9, 13 on the movable switching piece 12 and on the fixed switching piece 1 can impinge on one another in the event of a short circuit.

Figure 3:
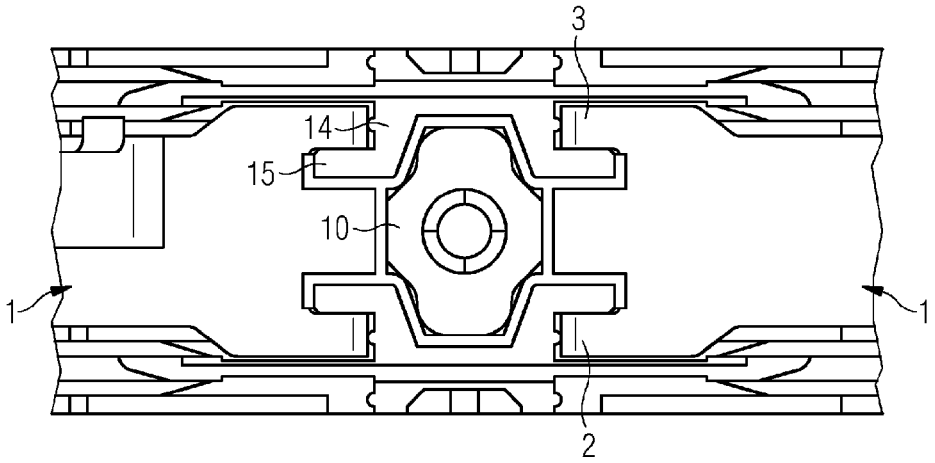
FIG. 3 shows a plan view of an arrangement comprising contact slide and two fixed switching pieces within a switching housing.

FIG. 3 illustrates the arrangement comprising the contact slide 10 and the fixed switching pieces 1 within a switching device housing. In this case, the contact slide 10 is integrated within the housing of the power circuit breaker in a contact slide accommodating device 14, which is designed in such a way that housing walls or mating contours 15 for the horned contours 2, 3, which housing walls or mating contours form the accommodating areas for the horned contours 2, 3, are arranged between the horned contours 2, 3 and the tab 8 of the fixed switching piece 1. The mating contours 15 are preferably L-shaped, wherein one limb protrudes out of the housing wall of the power circuit breaker and the other limb is preferably at a 90° angle with respect to the first limb and thus forms a cutout with respect to the housing wall for the horned contours 2, 3.

Figure 4:
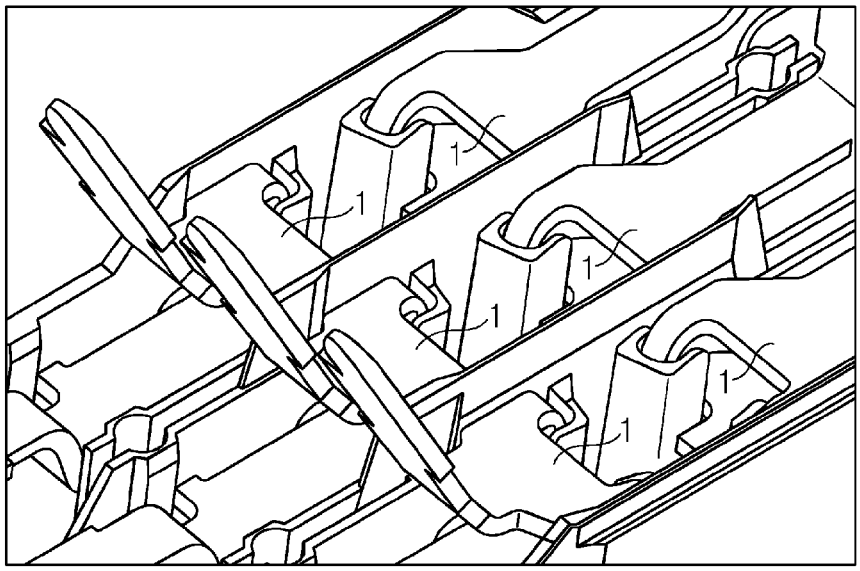
FIG. 4 shows a perspective illustration of the fixed switching pieces with horned contours integrated in a switching housing with mating contours for the horned contours.
Figure 5:
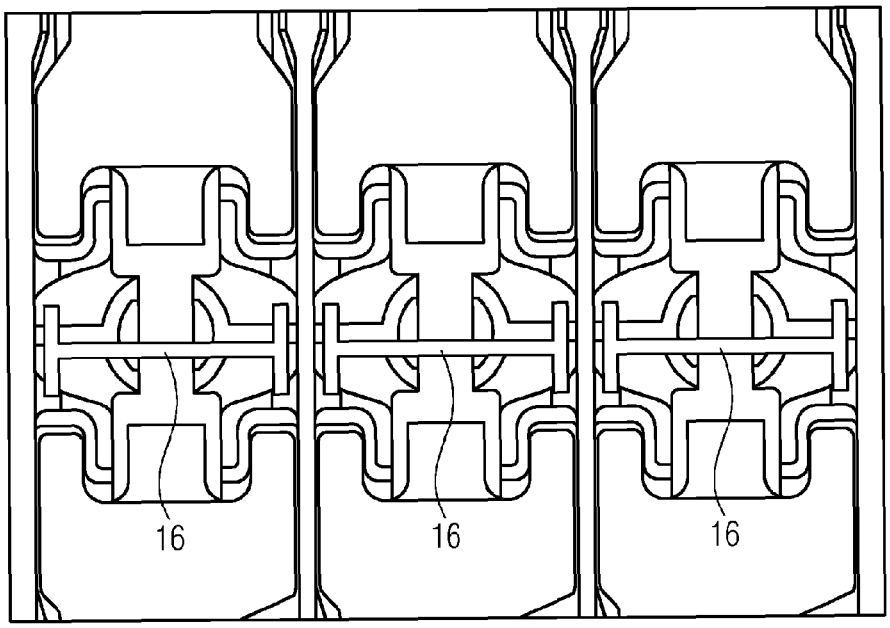
FIG. 5 shows a plan view of the arrangement shown in FIG. 4 with the series circuit of the clamping highlighted.

FIG. 4 illustrates an arrangement of the fixed switching pieces 1 aligned parallel to one another within a switching housing of a power circuit breaker. Preferably, three chambers are arranged within one power circuit breaker, which chambers each accommodate a contact slide 10 with two fixed switching pieces 1 opposite one another. FIG. 5 once again illustrates the series circuit 16 of the clamping within a switching device housing of a power circuit breaker. The clamping is based on the fact that the horned contours 2, 3 of the fixed switching pieces 1 engage in the cutouts in the mating contours 15 of the contact slide accommodating device.

The fixed switching pieces according to an embodiment of the invention with horned contours are characterized by the fact that they achieve a marked reinforcement of the switching chambers of the power circuit breaker without any additional parts. The bending of the housing is reduced by said fixed switching pieces. The switching pieces are fixed well, wherein the assembly sequence does not need to be changed. The protruding tab firstly enables an enlargement of the resting area for the contacts, and secondly ensures effective sealing with respect to the upper part of the power circuit breaker. The open cross section towards the top is reduced from approximately 160 mm2 to 60 mm2. In the event of a short circuit, the bending of the wall of the lower part of the power circuit breaker in the central region is limited. This limitation is, by first approximations, 20 to 25% of the previous bending. The lower part is thus bent out by this amount less than was previously the case. Thus, the risk of the upper part of the power circuit breaker being ripped out by the lower part being pressed against it is also reduced.

The invention claimed is:

1. A power circuit breaker comprising:

a housing;

a contact slide accommodating device within the housing;

a contact slide;

a fixed switching piece including a horned contour in the form of two webs which are aligned parallel to one another and which are spaced apart from one another by a cutout; and a movable switching piece, mounted on a spring arranged in the movable switching piece opposite the fixed switching piece, the horned contour of the fixed switching piece being configured to engage in mating contours on switching chamber walls of the power circuit breaker, wherein the contact slide accommodating device has mating contours that extend between the horned contour and a tab in the cutout.

2. The power circuit breaker of claim 1, wherein the fixed switching piece is U-shaped with two limbs and a transition region formed in a bend of the fixed switching piece, and wherein the transition region forms the horned contour.

3. The power circuit breaker of claim 1, wherein the tab, is an extension of a limb of the fixed switching piece, the tab extending into the cutout thereby enlarging a resting area for soldering contacts of the power circuit breaker.

4. The power circuit breaker of claim 1, wherein current flow is formed via the horned contour of the fixed switching piece.

5. The power circuit breaker of claim 2, wherein current flow is formed via the horned contour of the fixed switching piece.

6. The power circuit breaker of claim 1, wherein the horned contour of the fixed switching piece engages in a mating contour formed between the contact slide accommodating device and the switching chamber walls of the power circuit breaker.

* * * * *